US005588373A

United States Patent [19]

Bacskay

[11] Patent Number: 5,588,373

[45] Date of Patent: Dec. 31, 1996

[54] LIQUID CONTAINMENT PALLET

[75] Inventor: Stephen A. Bacskay, Central Islip, N.Y.

[73] Assignee: Chem-tainer Industries, Inc., West Babylon, N.Y.

[21] Appl. No.: 388,522

[22] Filed: Feb. 14, 1995

[51] Int. Cl.[6] ..... B65D 19/44

[52] U.S. Cl. ..... 108/55.3; 108/56.1; 206/386

[58] Field of Search ..... 108/51.1, 55.1, 108/55.3, 56.1, 56.3, 901; 206/386, 599

[56] References Cited

U.S. PATENT DOCUMENTS

| | | | |
|---|---|---|---|
| 3,677,436 | 7/1972 | Danielson | 206/599 X |
| 3,948,190 | 4/1976 | Cook, III et al. | 206/599 X |
| 4,756,425 | 7/1988 | Wise | 206/599 X |
| 4,848,711 | 7/1989 | Mandel | 108/55.3 X |
| 5,226,558 | 7/1993 | Whitney et al. | 206/386 X |
| 5,307,931 | 5/1994 | Gillispie et al. | 108/56.3 X |
| 5,359,955 | 11/1994 | Grebenyuk | 108/51.1 |
| 5,392,911 | 2/1995 | Gillispie et al. | 108/56.3 X |

FOREIGN PATENT DOCUMENTS

| | | | |
|---|---|---|---|
| 2020585 | 11/1992 | WIPO | 108/51.1 |

*Primary Examiner*—Peter M. Cuomo
*Assistant Examiner*—Janet M. Wilkens
*Attorney, Agent, or Firm*— Amster, Rothstein & Ebenstein

[57] ABSTRACT

A liquid containment pallet for supporting a plurality of containers containing liquids, the pallet comprising a unitarily molded confined basin defined by integral sidewalls and a bottom wall, the bottom defining integral transverse passageways for receiving the tines of a forklift for lifting and moving the pallet; the pallet further comprising a unitarily molded platform for supporting the containers and preventing the containers from sliding relative to the platform in a plurality of integrally formed recesses, each defined by a cylindrical sidewall and a bottom wall, the platform further including a plurality of downwardly projecting legs for supporting the platform with respect to the basin, at least one of the legs defining a trough for receiving spillage and including drainage provisions for communicating the spillage to the basin.

9 Claims, 3 Drawing Sheets

LIQUID CONTAINMENT PALLET

BACKGROUND

The present invention relates generally to pallets, and more specifically, to pallets for supporting liquid containing industrial containers or drums, the pallets further providing a containment volume for accumulating spillage from the containers.

There are many different types of pallet structures known in the art for supporting heavy containers or drums, particularly those containing hazardous liquids. Such containers are usually bulky and can be of substantial weight, requiring that the pallet configuration be capable of buttressing heavy loads. To facilitate handling, these pallets must be compatible to facilitate handling for use with a forklift or other lifting apparatus. Because the containers can rupture or leak, the need to adequately contain any liquid spillage has been recognized and addressed by the production of relatively complex and heavy designs, most of which are often difficult and expensive to manufacture.

Examples of pallets which satisfy these concerns may be found in U.S. Pat. Nos. 5,092,251 and 5,020,667. In both of these patents, a pallet assembly is comprised of a basin and a platform. The basin has a bottom arrangement which forms a plurality of feet for supporting the pallet on a support surface, and which forms slots to receive the tines of a forklift for transport. The platform is constructed and arranged for supporting a plurality of containers above the basin and permits any spillage from the containers to drain into the basin. In this regard, the platform in the '251 Patent has a nominal wall thickness with an undulate cross-section forming a plurality of peaks and troughs. In the '667 Patent, the platform is arranged in a grating configuration comprised of a plurality of spaced bars interconnected in cross-section and shaped to selectively direct spillage into the basin. These structures suffer from disadvantages in that their respective platform arrangements do not always provide enough support for the containers, the lack of which can result in the containers sliding on the platform during forklift operations, and can present an occupational hazard. Moreover, the platform structures utilized in these pallet configurations can be easily damaged during removal of the platform from the basin.

Other pallet configurations may be found in U.S. Pat. Nos. 4,413,737 and 4,029,023. These references teach pallets which are unitarily molded with a plurality of load-bearing walls and hat-sections for strength and stiffness. These pallets accumulate liquid spillage in pockets defined by the structural sections. Similar to the pallets disclosed in the '251 and '667 Patents, these designs suffer from the same disadvantages in that the containers are not adequately supported to prevent them from inadvertently shifting during handling or transport.

SUMMARY OF THE INVENTION

In view of the state of the art, it is an object of the present invention to provide a liquid containment pallet of rugged, yet simplified construction, having a unitarily molded basin and a unitarily molded platform for supporting containers or drums containing liquids, and providing for collection of spillage in the basin, the pallet being able to fully support the drums and prevent shifting thereof during forklift operations and transport.

It is another object of the present invention to provide a liquid containment pallet having a platform with a unitarily molded support structure, which platform is removably fit into a unitarily molded basin to provide a rigid support for a plurality of drums and a collection chamber for spilled liquids.

It is yet another object of the present invention to provide a liquid containment pallet comprised of a platform and a basin both of which may be formed in a single rotational molding process.

In accordance with the above objects and additional objects which will become apparent hereinafter, the present invention provides a liquid containment pallet comprised of a molded platform and basin, the platform being insertable into and removable from the basin. The platform is adapted for supporting a plurality of containers in a plurality of integrally formed recesses, each defined by a cylindrical sidewall and a bottom wall. The platform further includes a plurality of downwardly projecting legs for supporting the platform with respect to the basin, where at least one of the legs defines a trough for receiving spillage and includes means for communicating the spillage to the basin.

The basin is preferably tub-shaped and is principally comprised of integral sidewalls and a bottom wall. A plurality of integral transverse passageways are formed in the bottom wall to facilitate insertion of the tines of a forklift to enable lifting and transporting operations. The platform is removably fit into the basin to provide a storage volume for collecting spillage communicated to the basin. At least one of the legs of the platform includes a recessed bottom which interlocks with corresponding features in the bottom wall of the basis for structural integrity.

The platform and basin are preferably molded in a rotational molding process from a thermoplastic material exhibiting good corrosion resistance such as polyethylene. The configuration of the platform and basin disclosed herein are well-suited to a single rotational molding process. After molding, the platform and basin are separated into constituent parts in a simple machining operation, at which time drainage apertures may also be machined in the basin. This process and arrangement provides a structure which is durable, lightweight and yet economical to manufacture.

The advantages of a liquid containment pallet in accordance with the present invention will become more apparent as the detailed description of the invention proceeds hereinbelow with specific reference to the accompanying drawings.

DETAILED DESCRIPTION OF THE PREFERRED EMBODIMENT

Figure 1:
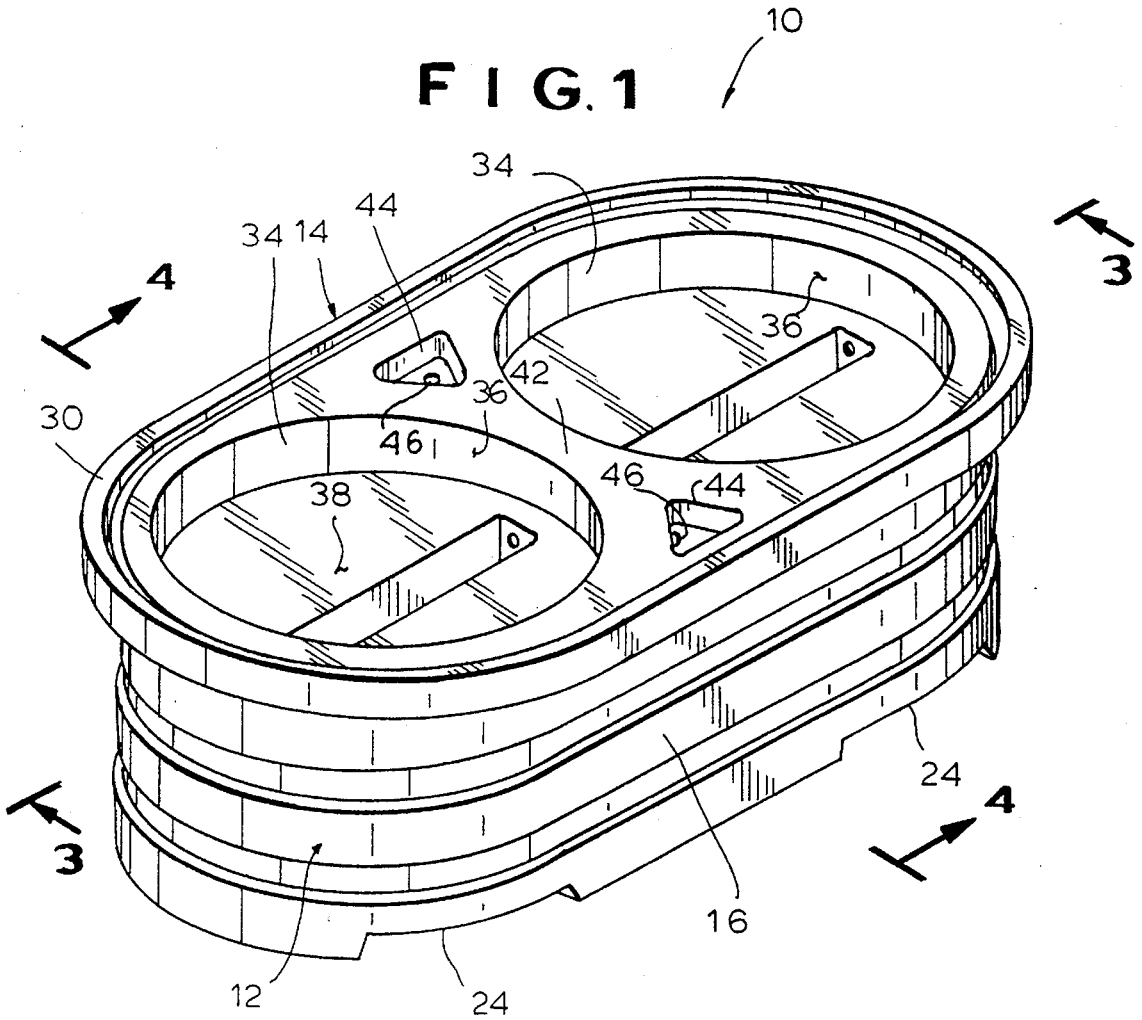
FIG. 1 is an isometric view of the liquid containment pallet assembly in accordance with the present invention.

With reference to the several views of the drawings, the liquid containment pallet is generally designated by the reference numeral 10, and is principally comprised of a basin 12 and a platform 14.

Figure 4:
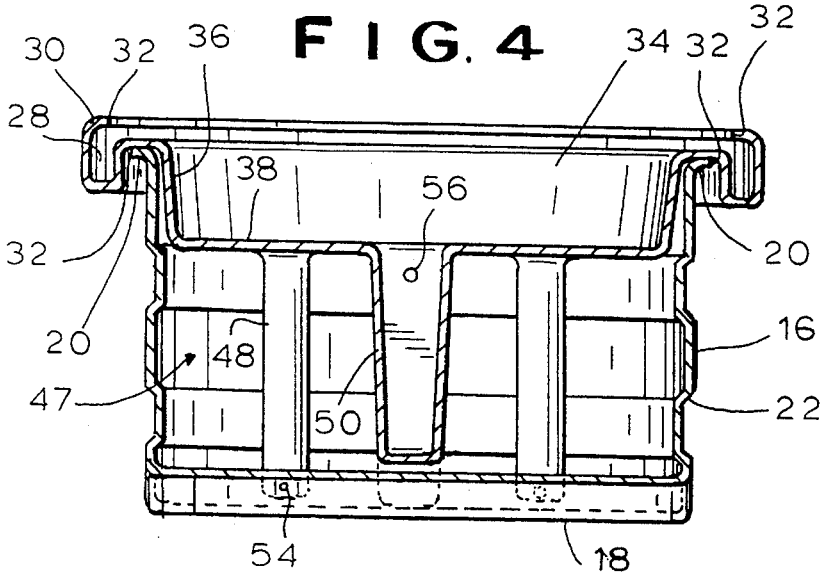
FIG. 4 is a sectional view along lines 4—4 in FIG. 1 showing details of the platform and the basin in the assembled configuration.
Figure 2:
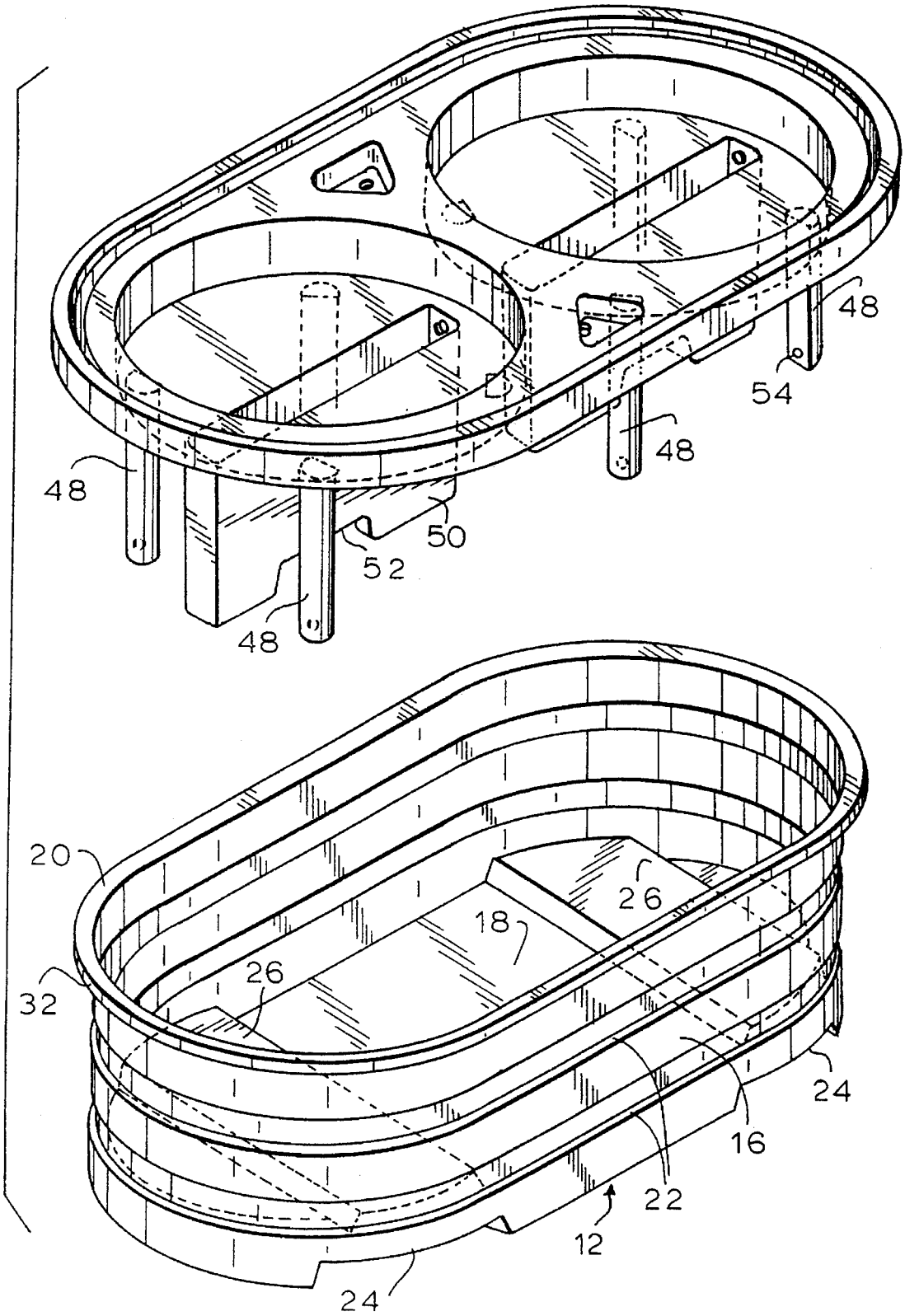
FIG. 2 is an exploded isometric view of the liquid containment pallet showing the platform and the basin.
Figure 3:
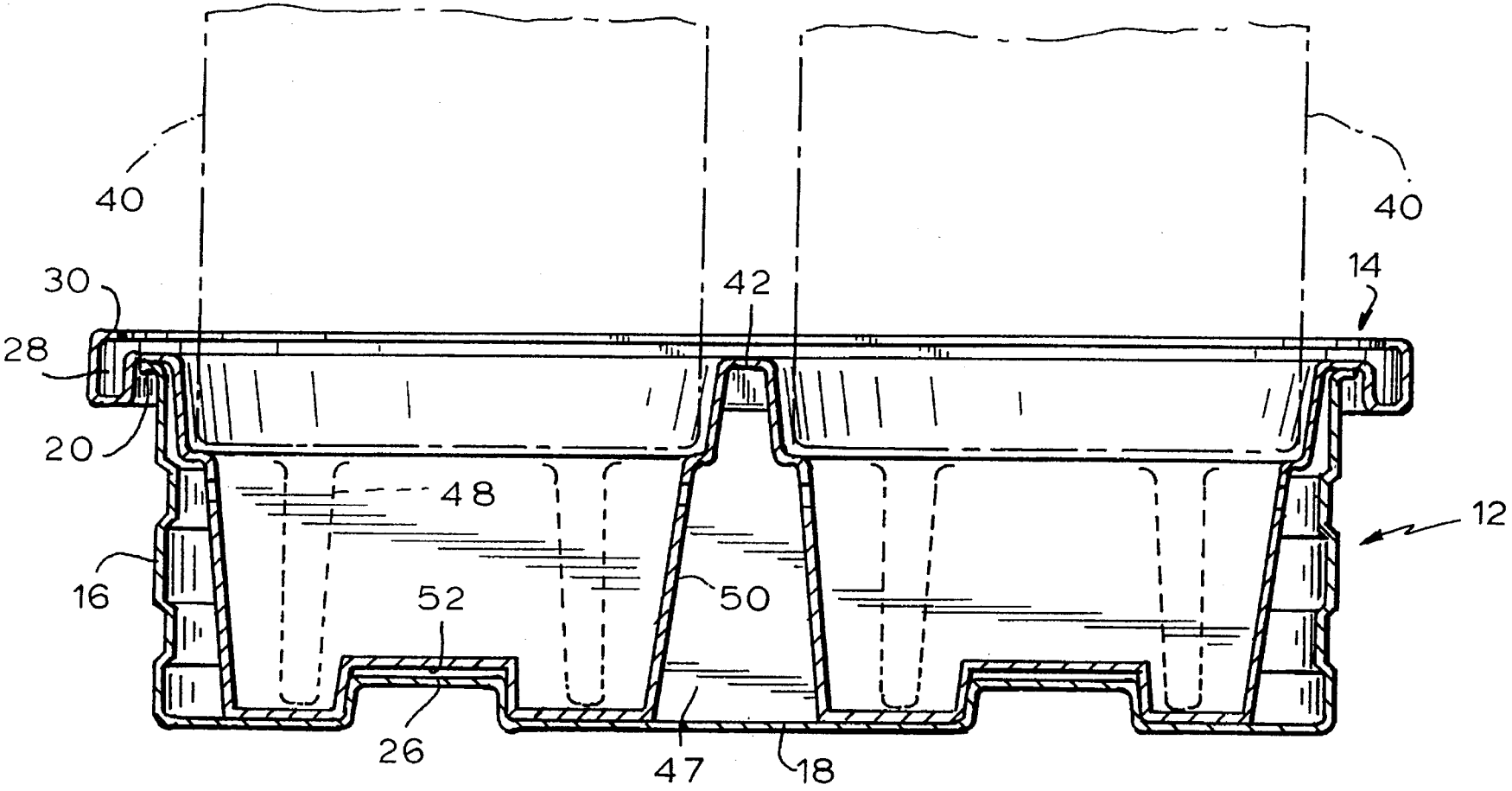
FIG. 3 is a sectional view along lines 3—3 in FIG. 1 showing details of the platform and the basin in the assembled configuration.

As seen in FIGS. 2, 3 and 4, the basin 12 is unitarily molded from a corrosion-resistant material such as polyethylene, preferably in a rotational molding process together with the platform 14 as will be explained in more detail below. In the illustrative embodiment, the basin 12 is a generally elongated, tub-shaped receptacle having integral sidewalls 16, a bottom wall 18 and an open top bordered by a peripheral flange 20. Of course, it is anticipated that other basin shapes could be employed and that such would fall within the scope of the invention. The sidewalls 16 are preferably molded with integral ribs 22 which are elongated and extend lengthwise around the basin. This arrangement imparts increased bending stiffness to the sidewalls 16, to provide the basin with greater durability and enhanced damage tolerance in the operative industrial environment. To provide a means for a forklift or other device to facilitate loading, unloading and transport of the pallet 10, a pair of transverse grooves 24 are defined in the bottom wall 18. As shown in FIG. 2, each of the grooves 24 form an oppositely disposed raised projection 26 to facilitate interlocking association with the legs of the platform as described below.

Referring now to FIGS. 1–4, the platform 14 is also unitarily formed from a corrosion resistant material such as polyethylene, preferably in a single rotational molding process. In this connection, the platform 14 includes a U-shaped channel 28 having an inwardly turned flange 30 disposed at the top of the platform 14. In the forming operation, the platform 14 and basin 12 are rotationally molded to produce a single initial structure with the flange 30 of the platform 14 integral with the flange 20 of the basin 12. Thus, after the molding operation, the platform 14 and basin 12 are separated from each other by machining the components along a split line identified by the reference numeral 32. Of course, it is anticipated that other molding processes and materials may be employed without departing from the scope of the invention. Returning now to the drawings, the platform 14 further includes a pair of integrally formed recessed areas 34 which are each defined by a cylindrical sidewall 36 and bottom wall 38. The diameter of the recess is sized so as to provide a means of support for a cylindrical drum or container 40 (shown in phantom in FIG. 3) and to ensure that the container 40 is prevented from sliding sideways relative to the platform 14 during transport or handling of the pallet 10. These could be formed in other shapes or in greater numbers if desired, depending upon the desired configuration. The surface immediately adjacent to the recessed areas 34 is identified by the reference numeral 42, and blends into the U-shaped channel 28. The channel 28 imparts stiffness to the platform 14 and provides an additional collection volume for accumulating excess spillage of liquids from the containers 40. The area 42 also is provided with a pair of "soap-dish" shaped depressions 44 and apertures 46 to facilitate inspection of the interior containment volume 47 formed by the basin 12 and platform 14. Drainage of spilled fluids collected in the basin 12 may be accomplished by placing a fluid-draining means coupled to a pumping apparatus (not shown) through either of the apertures 46. This obviates the need to remove the platform 14 and the containers 40 prior to draining of the basin 12.

To support the platform 14 relative to the basin 12, a plurality of legs, some of which are slender in cross section 48, and some of which are elongated in cross section 50, extend downwardly as best seen in FIG. 2. The legs 48 are typically spaced near the periphery of wall 36 to support the weight of the container 40, and are slightly tapered along their length to provide a small draft angle to facilitate molding. The legs 50 are preferably rectangular in cross section and are similarly tapered along the length thereof as shown in FIG. 3. The lower portion of each leg 50 includes a depressed area 52 which interfits with a corresponding projection 26 formed in the bottom wall 18 of the basin 12. This arrangement furnishes additional support for the platform 14 and prevents the platform 14 from moving laterally relative to the basin 12 during forklift operations. Both legs 48 and 50 preferably form a trough into which spillage from the container 40 may pass, and are respectively provided with drainage holes 54 and 56 communicating with the basin 12. The holes also eliminate the need to clean the individual legs since spillage will drain into the containment volume 47.

The present invention has been shown and described in what is considered to be the most practical and preferred embodiment. It is anticipated, however, that departures may be made therefrom and that obvious modifications will be implemented by persons skilled in the art.

I claim:

1. A liquid containment pallet for supporting at least one container for storing liquids, comprising:

a confined basin defined by integral sidewalls and a bottom wall, said bottom wall having integral means for receiving a pallet lifting means for lifting and moving said pallet; and a platform for detachably supporting at least one container, said platform having receiving means for supporting said at least one container in an elevated position relative to said bottom wall of said confined basin and preventing said container from sliding appreciably relative to said platform when supported on said platform, said platform including means for supporting said platform with respect to said basin and draining means for communicating spillage from said container to said basin, said platform and said basin collectively forming a liquid containment volume for accumulating said spillage.

2. The liquid containment pallet recited in claim 1, wherein said receiving means for supporting said at least one container comprise at least one recess integral with said platform, said recess defined by a cylindrical sidewall and a bottom wall.

3. The liquid containment pallet recited in claim 1, wherein said means for supporting said platform relative to said basin comprise a plurality of downwardly projecting legs, at least one of said legs defining a trough for receiving said spillage.

4. The liquid containment pallet recited in claim 1, wherein said platform includes means for inspecting and draining spillage from said basin.

5. A liquid containment pallet for supporting at least one container for storing liquids, comprising:

a confined basin defined by integral sidewalls and a bottom wall, said bottom wall having integral means for receiving a pallet lifting means for lifting and moving said pallet; and a platform for supporting a plurality of containers and preventing said containers from sliding appreciably relative to said platform when supported on said platform, said platform including a plurality of integrally formed recesses, each defining a cylindrical sidewall and a bottom wall, and a plurality of downwardly projecting legs for supporting said platform with respect to said basin, at least one of said legs defining a trough for receiving spillage and means for communicating spillage to said basin, said platform and said basin forming a liquid containment volume for accumulating said spillage.

6. The liquid containment pallet recited in claim 5, wherein at least one of said legs includes a depressed area formed at a bottom end of said leg for interlocking with a corresponding raised area formed in said bottom wall of said basin.

7. The liquid containment pallet recited in claim 5, wherein said platform includes means for inspecting and draining spillage from said basin.

8. A liquid containment pallet for supporting at least one container for storing liquids, comprising:

a unitarily molded confined basin defined by integral sidewalls and bottom wall, said bottom wall defining integral transverse passageways for receiving a pallet lifting means for lifting and moving said pallet; and a unitarily molded platform for supporting a plurality of containers and preventing said containers from sliding appreciably relative to said platform when supported on said platform, said platform including a plurality of integrally formed recesses, each defined by a cylindrical sidewall and a bottom wall, and a plurality of downwardly projecting legs, at least one of said legs defining a trough for receiving spillage and including means for communicating said spillage to said basin, said platform and said basin forming a liquid containment volume for accumulating said spillage.

9. A liquid containment pallet for supporting at least one container for storing liquids, comprising:

a confined basin defined by integral sidewalls and a bottom wall, said bottom wall having integral means for receiving a pallet lifting means for lifting and moving said pallet; and a platform for supporting at least one container, said platform having receiving means for supporting said at least one container and preventing said container from sliding appreciably relative to said platform when supported on said platform, said platform including a plurality of downwardly projecting legs, at least one of said legs defining a trough for receiving spillage, for supporting said platform with respect to said basin, said platform further including draining means for communicating spillage from said container to said basin, said platform and said basin forming a liquid containment volume for accumulating said spillage.

* * * * *